US005441009A

United States Patent [19]

Anderson

[11] Patent Number: 5,441,009

[45] Date of Patent: Aug. 15, 1995

[54] REMOVABLE WEAPON STOWAGE TRAY

[75] Inventor: Neil G. Anderson, Loretto, Minn.

[73] Assignee: FMC Corporation, Chicago, Ill.

[21] Appl. No.: 163,628

[22] Filed: Dec. 9, 1993

[51] Int. Cl.[6] ..... B63G 8/28

[52] U.S. Cl. ..... 114/316

[58] Field of Search ..... 114/312, 316; 212/218, 212/219, 211, 224; 414/22.51, 22.62, 23, 788

[56] References Cited

U.S. PATENT DOCUMENTS 3,262,593 7/1966 Hainer ..... 212/211
3,540,603 11/1970 Neumeier ..... 212/211
4,648,518 3/1987 Greeson ..... 212/211
4,664,873 5/1987 Hendrich et al. ..... 212/224
4,877,365 10/1989 Lanigan, Jr. et al. ..... 212/218

*Primary Examiner*—Stephen Avila
*Attorney, Agent, or Firm*—G. Wolde-Michael; R. C. Kamp; R. L. Andersen

[57] ABSTRACT

This disclosure relates to a method and device for removing weapon stowage trays particularly adapted to reconfiguration of a submarine weapon room. The device and method comprise of an adapter plate which is attachable to a shipping beam. The shipping beam is used to transport and enable the engagement of the adapter tray to a weapon tray to thereby allow the removal and transfer of the weapon tray.

6 Claims, 4 Drawing Sheets

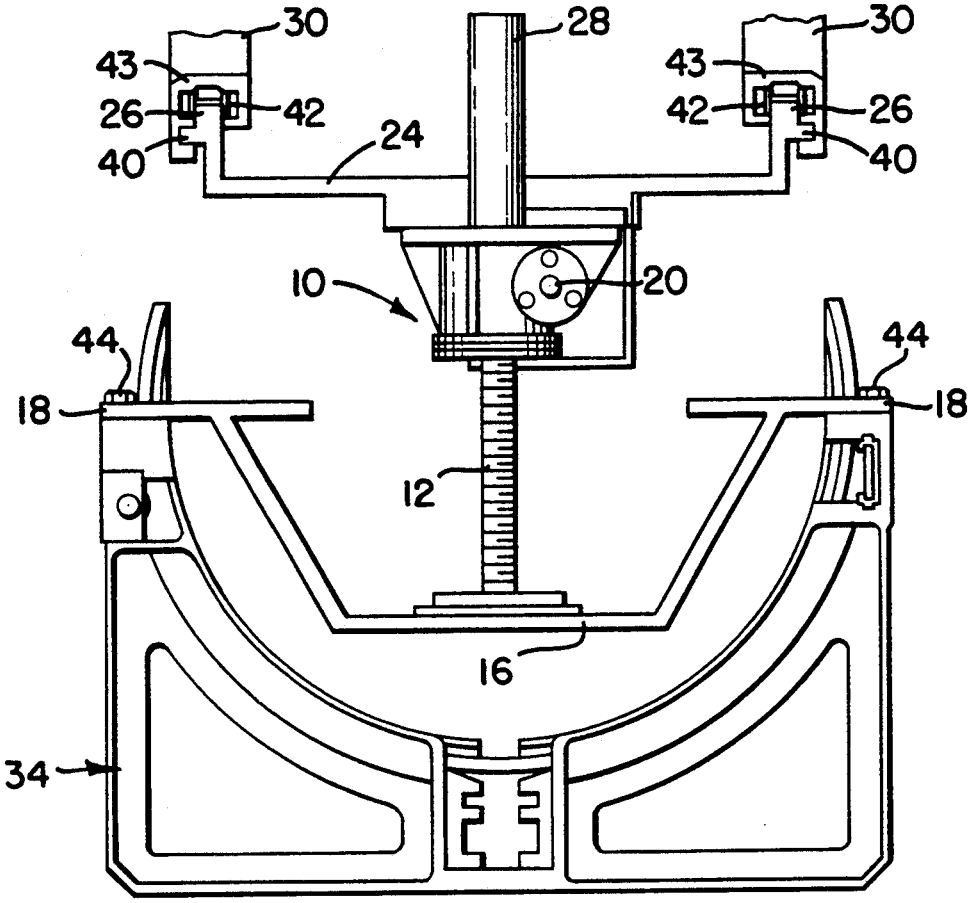
FIG_4A
FIG_4B
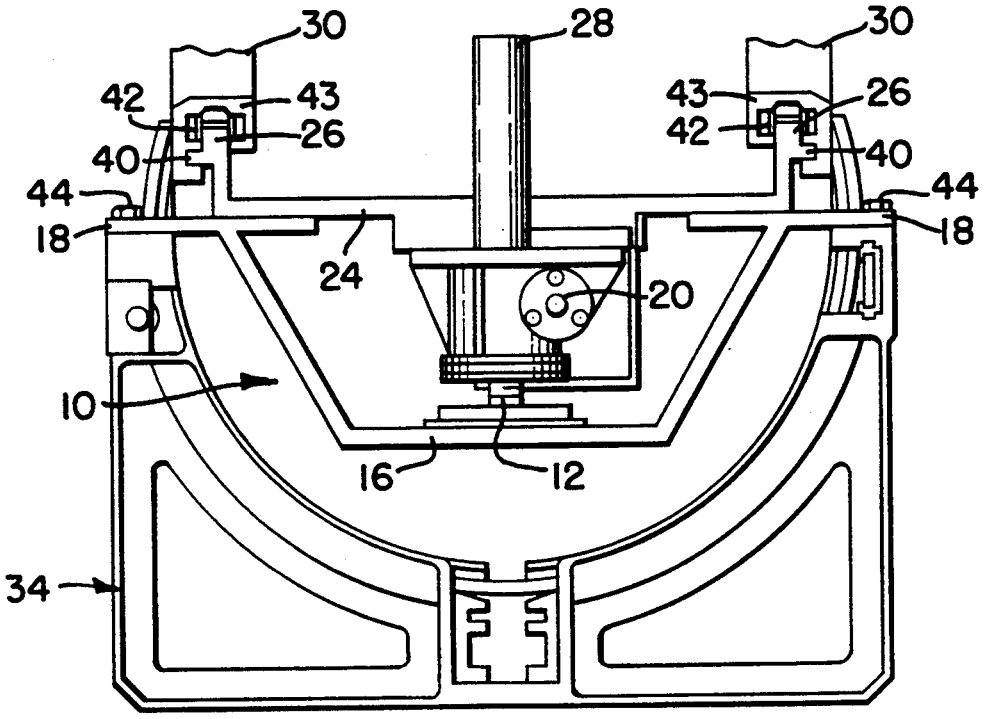

REMOVABLE WEAPON STOWAGE TRAY

FIELD OF THE INVENTION

The present invention relates to a method and device for removal of weapon trays. The method and device of the present invention enable removal of weapon trays from a weapon stowage complex. The weapon trays are removed to reconfigure the stowage area for some other use as dictated by mission requirements.

SUMMARY OF THE INVENTION

The present invention, specifically, enables the removal of trays to avail torpedo room spaces in a submarine to be utilized for other missions. Heretofore, to reconfigure a torpedo room, the weapons need to be removed first. Further, the dollies and lashing straps are removed to clear weapons from stowage structures. However, the stowage structures remain unremoved thus making it very difficult to use all the available space efficiently. The present invention eliminates these and related problems by providing a removable weapon tray. In the system contemplated by the present invention, the trays are the weapon support structures which are removably disposed to provide space for reconfiguration. The structural organizations of the present invention are particularly suited to adopt to future submarines which will be designed to meet multi-mission requirements and thereby require frequent and varied reconfiguration operations. Further, weight and volume constraints dictate that future submarine structures be versatile and adaptable to various mission objectives without major upgrade or overhaul. The present invention proffers advantages which are favorable to these objectives.

Specific advances, features and advantages of the present invention will become apparent upon examination of the following description and drawings dealing with several specific embodiments thereof.

BRIEF DESCRIPTION OF THE DRAWINGS

FIG. 4A is a frontal side view of the tray adapter engaging a weapon tray.

FIG. 4B is a frontal side view of the tray adapter in a retracted position engaging a weapon tray ready to be raised.

DESCRIPTION OF THE PREFERRED EMBODIMENT

The method and mechanism of the present invention provide an efficient and economical reconfiguration of submarine weapon stowage rooms. In the present invention reconfiguration is achieved by removing the weapons and stowage trays through the shipping trunk and shipping hatch. Particularly, a stowage tray adapter which is attachable to a shipping beam is used to engage the trays for transfer. The shipping beam is elevated to align with the shipping trunk. Two chain drives on the shipping beam move the tray adapter and tray assembly through the shipping hatch for transfer to dockside storage. In the alternate, the method and mechanism of the present invention may be used to transfer weapon trays from dockside storage into a submarine weapon room. Accordingly, as will be discussed hereinbelow, the method and mechanism of this invention provide a significant advance for transfer and stowage of weapon trays by enabling reconfiguration without a major structural overhaul and redesign of the weapon room.

Figure 1:
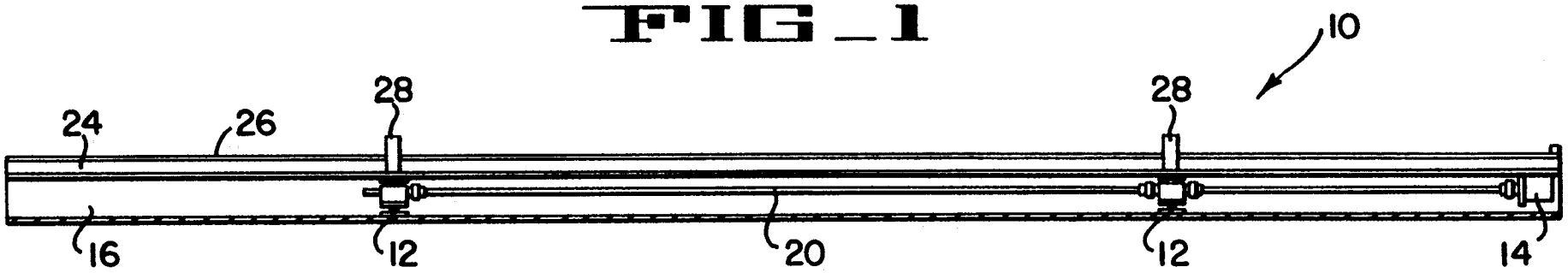
FIG. 1 is a central longitudinal section through the tray adapter.
Figure 1A:
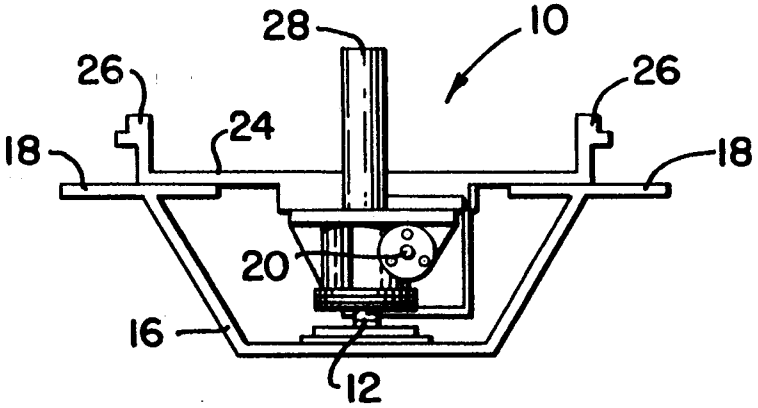
FIG. 1A is an end view of the tray adapter.
Figure 1B:
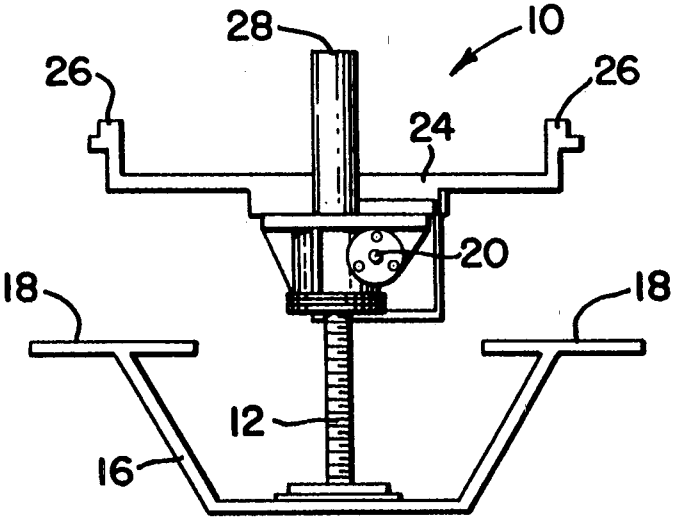
FIG. 1B is an end view of the tray adapter in an extended position.

A principal embodiment of the device is shown in FIGS. 1, 1A and 1B. Tray adapter 10 comprises trough 16 with flanges 18. A plurality of screw jacks 12 are centrally disposed in trough 16. Hydraulic motor 14 drives screw jacks 12 via a common universal joint connecting arm 20. Flange 24, upright assembly 26 and motor 14 are mounted to ride along with the screw jack housing 28.

Figure 2:
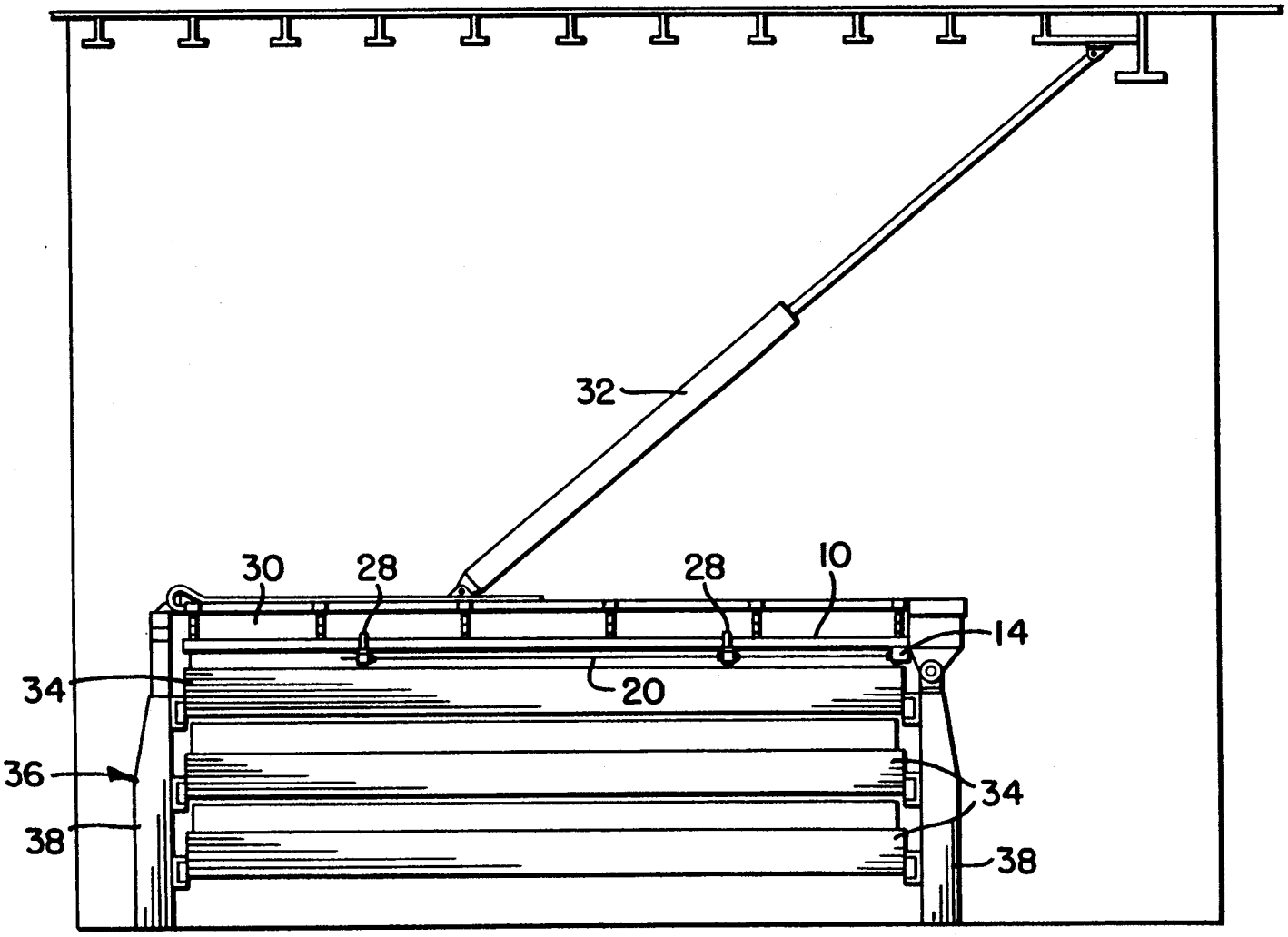
FIG. 2 is an elevation view of a shipping beam lowered onto a stowage tray.

Referring now to FIG. 2, tray adapter 10 is attached to shipping beam 30 and telescoping arm 32 transports the assembly to engage weapon tray 34 which is stored on rack 36. Forward and aft structures 38 are large steel weldments and support the ends of weapon trays 34. Weapon trays 34 are mechanically latched to tracks attached to remain fixed while flanges 18 and trough 16 move with screw jack 12.

Figure 3:
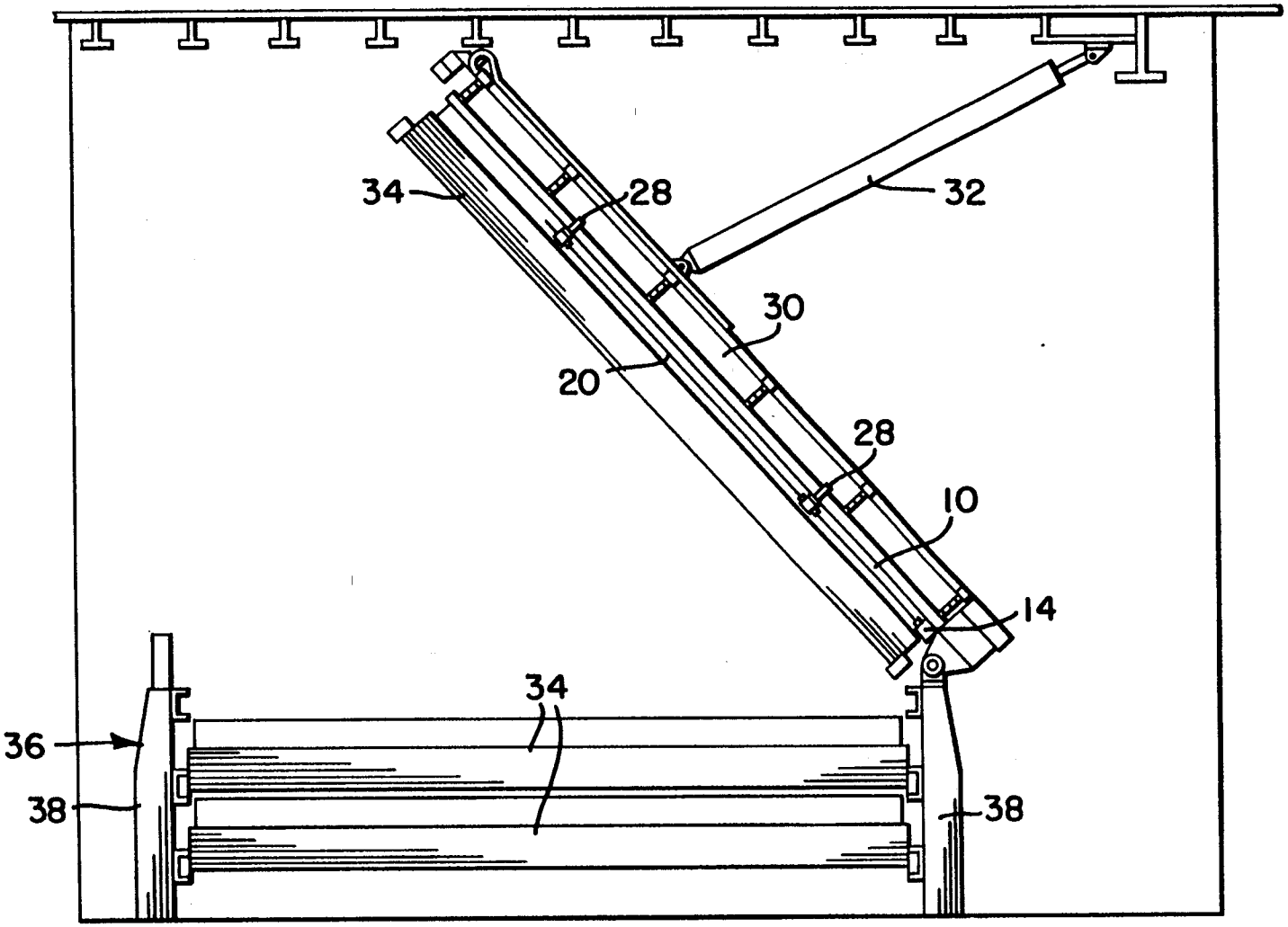
FIG. 3 is an elevation view showing the shipping beam with tray adapter and shipping tray attached thereto in a raised position.

FIG. 3 shows telescoping arm 32 retracted and shipping beam 30 with tray adapter 10 and weapon tray 34 raised to be off-loaded through the shipping hatch (not shown).

FIGS. 4A and 4B show initial and final stages, respectively, of engagement of shipping beam 30 and adapter tray 10 with weapon tray 34. Locking pins 44, secure the weapon tray to adapter tray 10. Retaining caps position weapon tray 34 in forward and aft structures 38.

The disclosure hereinabove relates to some of the most prominent structural features of the present invention. The operation and the cooperative aspects of the structures, under a best mode scenario, is described hereinbelow.

Referring to FIG. 1, motor 14 operates screw jacks 12 to raise and lower trough 16 and flanges 18. This feature enables adapter tray 10 to be in an extended and retracted position. The extendibility feature provides ease of alignment between weapon tray 34 and flange 18 (see FIG. 4A). Screw jacks 12 are fixed in trough 16 and provide load bearing support as well as level changing for alignment. Further, flanges 18 and trough 16 move with screw jack 12 thus enabling an extended and retracted positioning of trough 16 and flanges 18. The assembly of FIG. 1 is attached to shipping beam 30 to engage weapon tray 34.

Referring now to FIG. 2, tray adapter 10 is attached to shipping beam 30. A telescoping arm 32 having structural connections at a first end and attachments to shipping beam 30 on the second end transports the assembly and lowers it to engage weapon tray 34. When adapter tray 10 is secured to the top weapon tray 34, supports located at each end of structures 38 are released. More particularly, locking pins 44 (see FIG. 4) are attached and retaining caps (not shown) are removed to release weapon tray 34 and remove it. Accordingly, with reference to FIG. 3, shipping beam 30 is elevated to align with shipping trunk (not shown). Transfer of each weapon tray 34 is thus effectuated through the cooperative elements of the present invention and reconfiguration is achieved by removal of weapon trays 34 through the shipping trunk and shipping hatch.

Referring now to FIGS. 4A and 4B, engagements of tray adapter 10 with shipping beam 30 and consequently with weapon tray 34 are shown in detail. As discussed hereinabove, one of the significant elements in the present invention is adapter tray 10 and its co-operation with shipping beam 30. Upright assembly 26 comprises lip 40 to form a rail system. Two chains 42 are extended from shipping beam 30. Chain and rail housing 43 is connected to beam 30. Initially, as discussed hereinabove, tray adapter 10 is loaded onto shipping beam 30 and the units are slidably connected as shown. The assembly is lowered into a torpedo room. Shipping beam 30 is then lowered onto weapon tray 34. Tray adapter 10 is extended (See FIG. 4A), and consequently flange 24, upright assembly 26 and motor 14 are positioned above trough 16. This enables to align tray adapter 10 in place and secure locking pins 44. Further, retaining caps are removed from both forward and aft structures 38 (see FIGS. 2 and 3) thus readying weapon tray 34 for removal. The tray adapter is then retracted (See FIG. 4B) and shipping beam 30 is raised. Accordingly, weapon tray 34 is off-loaded through the shipping hatch (not shown).

As indicated in the best mode embodiments disclosed hereinabove, system reconfigurability is achievable by removal of weapon trays 34 by means of the elements and cooperation thereof of the present invention. Particularly, tray adapter 10 provides a unique advantage in facilitating the removal of weapon tray 34.

While a preferred embodiment of the present invention has been shown and described, it will be appreciated that various changes and modifications may be made therein without departing from the spirit of the invention as defined by the scope of the appended claims.

What is claimed is:

1. A device for removing a weapon tray comprising:

an extendible and retractable assembly;

at least one drive motor and at least one universal joint connected to drive a plurality of screw jacks with said assembly;

said assembly movably mounted to ride on said screw jacks;

a shipping beam; and means for connecting said assembly to said shipping beam.

2. The device according to claim 1 wherein said extendable and retractable assembly includes a flange and upright assembly movably attached to said universal joint and said screw jacks.

3. The device according to claim 1 wherein said means for connecting said assembly to said shipping beam includes a telescoping arm.

4. A method of reconfiguring a weapon room comprising the steps of:

aligning a weapon tray adapter in an extended position to a weapon tray;

retracting said weapon tray adapter to attach to and lift said weapon tray;

attaching a shipping beam to said weapon tray adapter; and lifting and transporting said tray adapter in a retracted position, said weapon tray and shipping beam.

5. The method according to claim 4 wherein said step of aligning includes attaching said tray adapter to said weapon tray by setting said tray adapter inside a trough of said weapon tray and retracting said adapter tray for supporting and attaching flanges of said weapon tray adapter to flanges of said weapon tray.

6. The method according to claim 4 wherein said step of aligning includes fixing at least one screw jack in said weapon tray to provide load bearing support.

* * * * *